US008424987B2

(12) United States Patent
Fukuda

(10) Patent No.: US 8,424,987 B2
(45) Date of Patent: Apr. 23, 2013

(54) LIQUID EJECTING APPARATUS AND LIQUID EJECTING METHOD

(75) Inventor: Shunya Fukuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 174 days.

(21) Appl. No.: 12/909,777

(22) Filed: Oct. 21, 2010

(65) Prior Publication Data

US 2011/0096110 A1 Apr. 28, 2011

(30) Foreign Application Priority Data

Oct. 23, 2009 (JP) ..... 2009-244171

(51) Int. Cl.
*B41J 29/38* (2006.01)

(52) U.S. Cl.
USPC ..... 347/9; 347/14

(58) Field of Classification Search ..... 347/23, 347/35, 9, 14
See application file for complete search history.

(56) References Cited

U.S. PATENT DOCUMENTS 6,641,251 B1 * 11/2003 Rodriguez ..... 347/40
7,436,545 B2 * 10/2008 Tomioka et al. ..... 358/1.9
7,465,006 B2 * 12/2008 Edamura et al. ..... 347/14
7,532,362 B2 * 5/2009 Fujimori ..... 358/3.06
2003/0112284 A1 * 6/2003 Otsuki ..... 347/9
2005/0168507 A1 * 8/2005 Ide et al. ..... 347/12

FOREIGN PATENT DOCUMENTS

JP 2002-205385 A 7/2002
JP 2005-138323 A 6/2005

* cited by examiner

*Primary Examiner* — Julian Huffman
*Assistant Examiner* — Sharon A Polk
(74) *Attorney, Agent, or Firm* — Kilpatrick Townsend & Stockton LLP

(57) ABSTRACT

A liquid ejecting apparatus includes a head that ejects liquid on a medium; a head-moving unit that moves the head in a moving direction; a timer that measures a hold period in which the head does not eject the liquid; and a controller that controls ejection of the liquid from the head in accordance with the hold period, the controller controlling the head to eject the liquid in one of modes including first and second modes. In the first mode, the head ejects the liquid during one of forward scanning and backward scanning in the moving direction, and then ejects the liquid during the forward scanning and the backward scanning in the moving direction. In the second mode, the head ejects the liquid during the forward scanning and the backward scanning in the moving direction.

8 Claims, 11 Drawing Sheets

LIQUID EJECTING APPARATUS AND LIQUID EJECTING METHOD

BACKGROUND

1. Technical Field

The present invention relates to a liquid ejecting apparatus and a liquid ejecting method.

2. Related Art

Ink jet printers that form images by ejecting ink while moving heads are used. Such printers include a printer that forms an image by ejecting ink in both forward and backward scanning directions of a head (for example, see JP-A-2002-205385 and JP-2005-138323).

In such a printer, if an ink-non-ejection period is long, a phenomenon called "thickening" in which viscosity of ink increases may occur. If the ink thickens, an ink-flying characteristic may be changed because, for example, an ink-ejection speed decreases. To supply the ink that is not thickening, a flushing operation in which the thickening ink is ejected on a position other than a medium may be performed. However, the flushing operation causes the consumption of the ink to increase. If the consumption of the ink increases, print cost may increase. Hence, it is desirable to decrease the consumption of the ink.

SUMMARY

An advantage of some aspects of the invention is to decrease the consumption of ink.

According to an aspect of the invention, a liquid ejecting apparatus includes a head that ejects liquid on a medium; a head-moving unit that moves the head in a moving direction; a timer that measures a hold period in which the head does not eject the liquid; and a controller that controls ejection of the liquid from the head in accordance with the hold period, the controller controlling the head to eject the liquid in one of modes including first and second modes. In the first mode, the head ejects the liquid during one of forward scanning and backward scanning in the moving direction, and then ejects the liquid during the forward scanning and the backward scanning in the moving direction. In the second mode, the head ejects the liquid during the forward scanning and the backward scanning in the moving direction.

Other features of the invention will be described in the specification with reference to the attached drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
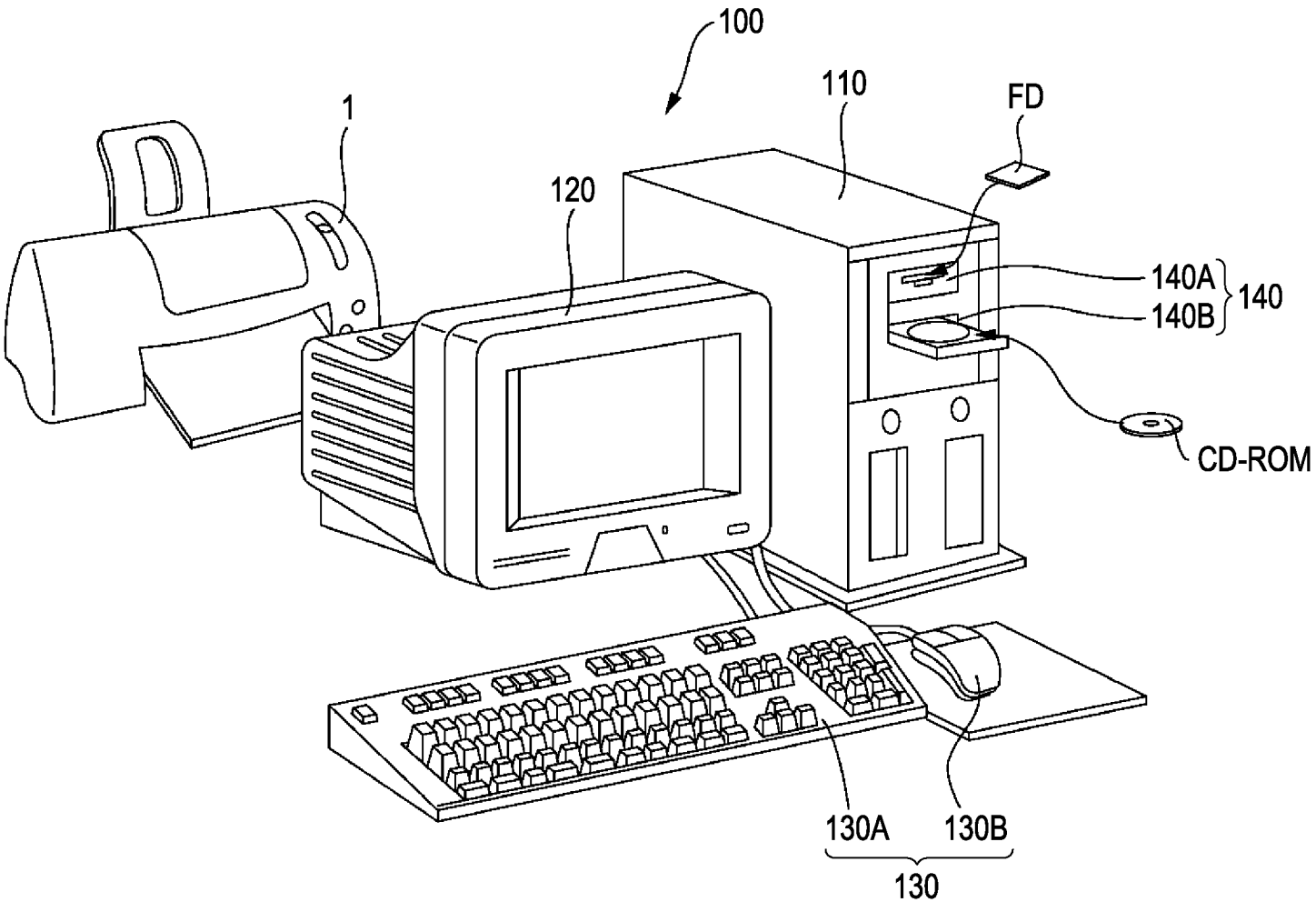
FIG. 1 is an explanatory view showing an external configuration of a print system 100.

With reference to the specification and the attached drawings, at least the following matters will be defined.

A liquid ejecting apparatus according to an aspect of the invention includes a head that ejects liquid on a medium; a head-moving unit that moves the head in a moving direction; a timer that measures a hold period in which the head does not eject the liquid; and a controller that controls ejection of the liquid from the head in accordance with the hold period, the controller controlling the head to eject the liquid in one of modes including first and second modes. In the first mode, the head ejects the liquid during one of forward scanning and backward scanning in the moving direction, and then ejects the liquid during the forward scanning and the backward scanning in the moving direction. In the second mode, the head ejects the liquid during the forward scanning and the backward scanning in the moving direction.

With this configuration, in the liquid ejecting apparatus that can form an image by ejecting the liquid during both the forward scanning and the backward scanning of the head, the liquid can be ejected during one of the forward scanning and the backward scanning in the moving direction of the head if thickening ink is used. Thus, a problem in which a target landing position during the forward scanning is not aligned with a target landing position during the backward scanning can be prevented from occurring. An image with a high quality can be formed on the medium although the flushing operation for ejecting the liquid on a position other than the medium is not performed. Since the flushing operation is not performed, the consumption of the liquid can be decreased.

Preferably in the liquid ejecting apparatus, the controller may control the head to eject the liquid in the first mode if the hold period is longer than a predetermined period. Alternatively, the controller may control the head to eject the liquid in the second mode if the hold period is a predetermined period or shorter. The head may eject the liquid during one of the forward scanning and the backward scanning in the moving direction in the first mode until the ejection of the liquid on a predetermined number of media is completed. Alternatively, the head may eject the liquid during one of the forward scanning and the backward scanning in the moving direction in the first mode until the ejection of the liquid by a predetermined liquid quantity is completed.

Still alternatively, the head may eject the liquid during one of the forward scanning and the backward scanning in the moving direction in the first mode until a predetermined time elapses. Also, a moving speed of the head when the head ejects the liquid during one of the forward scanning and the backward scanning in the moving direction in the first mode may be lower than a moving speed of the head when the head ejects the liquid during the forward scanning and the backward scanning in the moving direction.

With this configuration, the consumption of the liquid can be decreased.

A liquid ejecting method according to another aspect of the invention includes measuring a hold period of a head that ejects a liquid on a medium, the hold period being a period in which the head does not eject the liquid; and ejecting the liquid by one of processes in accordance with the hold period. The processes includes ejecting the liquid from the head during one of forward scanning and backward scanning in the moving direction of the head, and then ejecting the liquid during the forward scanning and the backward scanning in the moving direction, and ejecting the liquid from the head during the forward scanning and the backward scanning in the moving direction.

With this configuration, the consumption of the liquid can be decreased.

Exemplary Embodiment

Configuration of Print System

An exemplary embodiment of a print system (computer system) will be described below with reference to the attached drawings. It is to be noted that the following embodiments include embodiments of a computer program and a storage medium storing a computer program.

FIG. 1 is an explanatory view showing an external configuration of a print system 100. The print system 100 includes a printer 1, a computer 110, a display device 120, an input device 130, and a recording and reproducing device 140. The printer 1 is a printing device that prints an image on a medium, such as a sheet of paper, a piece of cloth, or a film. The computer 110 is electrically connected to the printer 1. To cause the printer 1 to print an image, the computer 110 outputs print data to the printer 1. The print data corresponds to the image to be printed. The display device 120 includes a display, and displays user interfaces of, for example, an application program and a printer driver. The input device 130 includes, for example, a keyboard 130A and a mouse 130B. The input device 130 is used for operating the application program and for setting the printer driver with the user interfaces displayed on the display device 120. The recording and reproducing device 140 includes, for example, a flexible disk drive 140A and a CD-ROM drive 140B.

A printer driver is installed in the computer 110. The printer driver is a program that provides a function for causing the display device 120 to display the user interfaces, and a function for converting image data output from the application program into print data. The printer driver is stored in a storage medium (a computer-readable storage medium), such as a flexible disk (FD) or a CD-ROM. Alternatively, the printer driver may be downloaded to the computer 110 through the Internet. The program includes codes for providing the functions.

"The printing device" is the printer 1 in a narrow sense, but is a system including the printer 1 and the computer 110 in a broad sense.

Configuration of Ink Jet Printer

Figure 2:
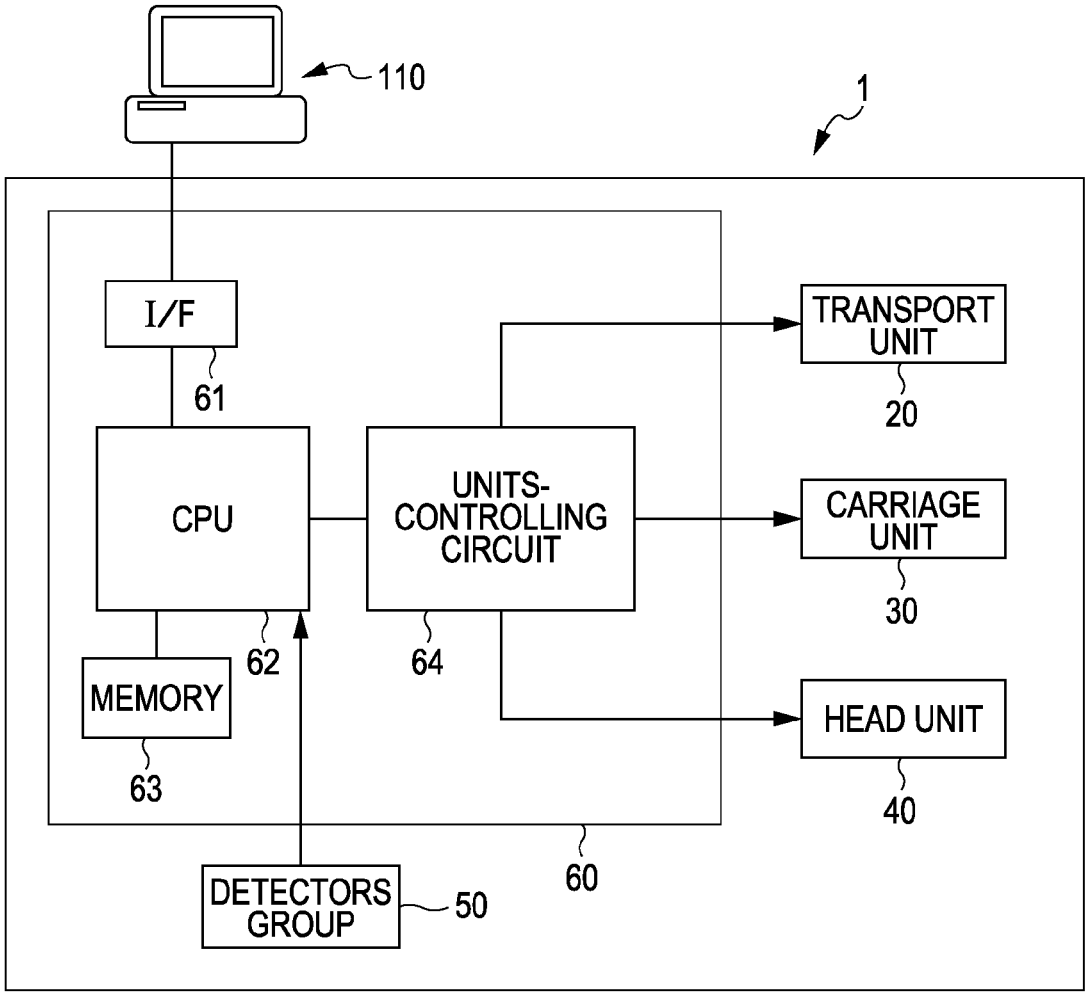
FIG. 2 is a block diagram showing a general configuration of a printer according to an exemplary embodiment.
Figure 3A:
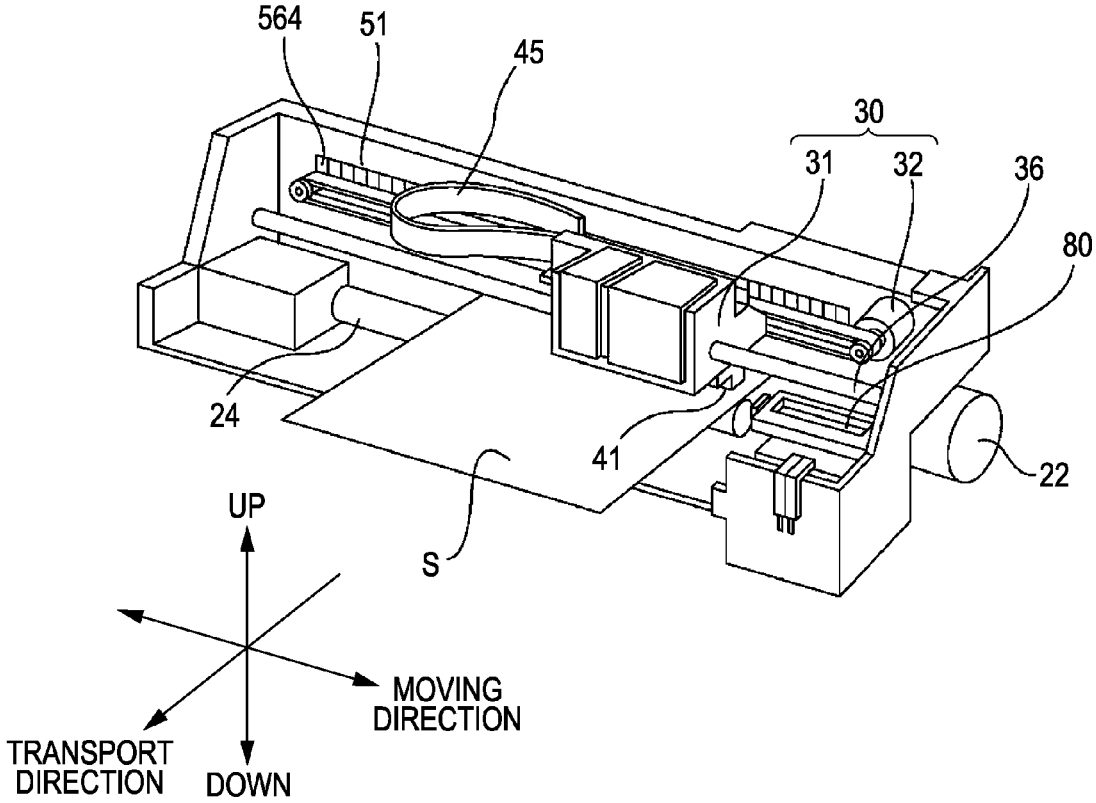
FIG. 3A briefly illustrates the general configuration of the printer according to the embodiment.
Figure 3B:
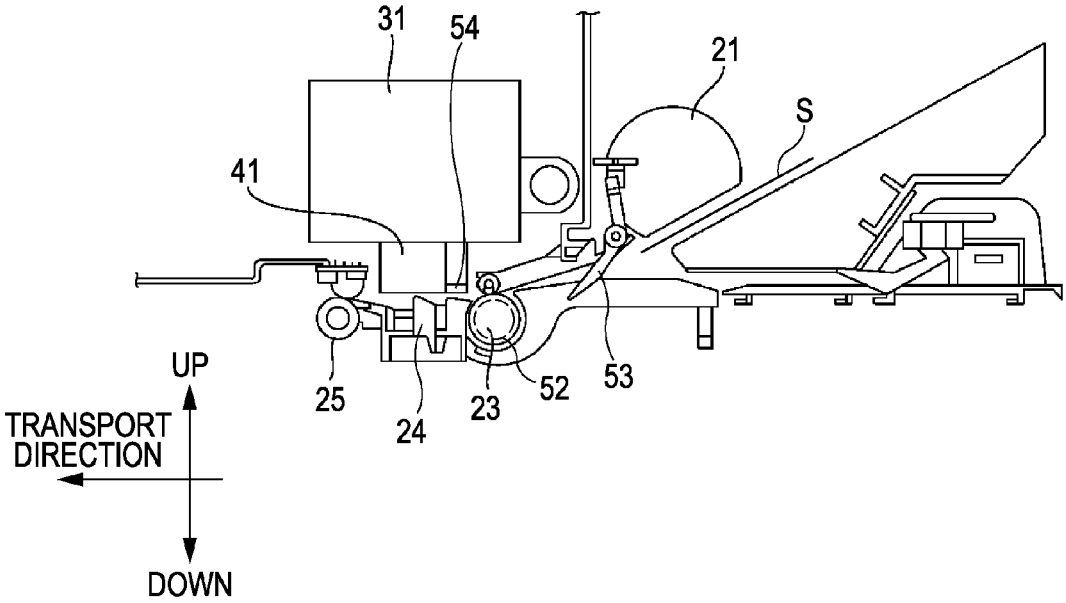
FIG. 3B is a cross-sectional view showing the general configuration of the printer according to the embodiment.

FIG. 2 is a block diagram showing a general configuration of the printer 1 according to the embodiment. FIG. 3A briefly illustrates the general configuration of the printer 1 according to the embodiment. FIG. 3B is a cross-sectional view showing the general configuration of the printer 1 according to the embodiment. A basic configuration of the printer 1 according to this embodiment will be described below.

The printer 1 according to this embodiment includes a transport unit 20, a carriage unit 30, a head unit 40, a detectors group 50, and a controller 60. The printer 1 that has received the print data from the computer 110, which serves as an external device, uses the controller 60 to control the respective units (the transport unit 20, the carriage unit 30, and the head unit 40). The controller 60 controls the respective units in accordance with the print data received from the computer 110, to form an image on a sheet. The detectors group 50 monitors the state in the printer 1. The detectors group 50 outputs the detection result to the controller 60. When the controller 60 receives the detection result from the detectors group 50, the controller 60 controls the respective units on the basis of the detection result.

The transport unit 20 feeds a medium (for example, sheet S) to a printable position, and transports the medium in a predetermined direction (hereinafter, referred to as transport direction) at a predetermined transport rate during printing. That is, the transport unit 20 functions as a transport mechanism that transports a sheet. The transport unit 20 includes a sheet-feed roller 21, a transport motor 22 (also referred to as PF motor), a transport roller 23, a platen 24, and a sheet-output roller 25. However, when the transport unit 20 functions as the transport mechanism, not all the components are required. The sheet-feed roller 21 automatically feeds a sheet, which has been inserted to a sheet insertion port, into the printer 1. The sheet-feed roller 21 has a D-shaped cross section. The sheet-feed roller 21 has a larger length of a circumferential portion than a transport distance from the sheet-feed roller 21 to the transport roller 23. Hence, the sheet-feed roller 21 can transport a sheet S to the transport roller 23 by using the circumferential portion. The transport motor 22 is a DC motor, and transports the sheet S in the transport direction. The transport roller 23 transports the sheet S, which has been fed by the sheet-feed roller 21, to a printable region. The transport roller 23 is driven by the transport motor 22. The platen 24 supports the sheet S during the printing. The sheet-output roller 25 outputs the sheet S outside the printer 1 after the printing. The sheet-output roller 25 rotates synchronously with the transport roller 23.

The carriage unit 30 moves a head (scans with a head) in a predetermined direction (hereinafter, referred to as moving direction). The carriage unit 30 includes a carriage 31 and a carriage motor 32 (also referred to as CR motor). The carriage 31 can reciprocate in the moving direction (accordingly, the head moves in the moving direction). Also, the carriage 31 detachably holds an ink cartridge containing ink. The carriage motor 32 is a DC motor, and moves the carriage 31 in the moving direction.

The head unit 40 ejects ink on a sheet. The head unit 40 includes a head 41. The head 41 has a plurality of nozzles serving as ink ejection portions. The nozzles intermittently eject ink. The head 41 is provided on the carriage 31. Hence, when the carriage 31 moves in the moving direction, the head 41 also moves in the moving direction. If the head 41 intermittently ejects the ink while the head 41 moves in the moving direction, a dot line (raster line) is formed on a sheet in the moving direction. The head unit 40 acquires data for driving the head 41 from the controller 60 in a printer body through a cable 45. The cable 45 is a flexible flat cable, and is electrically connected to the printer body and the carriage 31.

The detectors group 50 includes a linear encoder 51, a rotary encoder 52, a sheet-detecting sensor 53, an optical sensor 54, etc. The linear encoder 51 detects the position of the carriage 31 in the moving direction. The rotary encoder 52 detects a rotating amount of the transport roller 23. The sheet-detecting sensor 53 detects the position of the leading edge of the sheet to be printed. The sheet-detecting sensor 53 is provided at a position at which the sheet-detecting sensor 53 can detect the position of the leading edge of the sheet while the sheet-feed roller 21 feeds the sheet toward the transport roller 23. The sheet-detecting sensor 53 is a mechanical sensor that detects the leading edge of the sheet by using a mechanical mechanism. To be more specific, the sheet-detecting sensor 53 includes a lever that is rotatable in the transport direction. The lever is arranged to protrude into a transport path for the sheet. Thus, the leading edge of the sheet contacts the lever, and rotates the lever. The sheet-detecting sensor 53 detects the motion of the lever, and detects the position of the leading edge of the sheet. The optical sensor 54 is attached to the carriage 31. The optical sensor 54 detects the presence of the sheet. In particular, the optical sensor 54 includes a light-emitting portion and a light-receiving portion, and detects the presence of the sheet such that the light-emitting portion irradiates the sheet with light and the light-receiving portion detects the reflected light. The optical sensor 54 detects the position of the edge of the sheet while the optical sensor 54 is moved by the carriage 31. The optical sensor 54 optically detects the edge of the sheet. Hence, the optical sensor 54 has a higher detection accuracy than the mechanical sheet-detecting sensor 53.

The controller 60 is a control unit that controls the printer 1. The controller 60 includes an interface (I/F) unit 61, a CPU 62, a memory 63, and a units-controlling circuit 64. The interface unit 61 enables data transmission between the computer 110, which serves as the external device, and the printer 1. The CPU 62 is a processing unit that controls the entire printer 1. The memory 63 provides a storage area for a program of the CPU 62 and a work area for the CPU 62. The memory 63 includes a storage unit, such as a RAM or an electrically erasable programmable read-only memory (EEPROM). The CPU 62 controls the respective units through the units-controlling circuit 64 in accordance with the program stored in the memory 63.

The controller 60 according to this embodiment has a timer function for measuring a time.

A head cap 80 is a portion to which the ink is ejected during a flushing operation. To prevent the ink from drying through the nozzle of the head 41, the head 41 is fitted to the head cap 80 when printing is not performed.

Figure 4A:
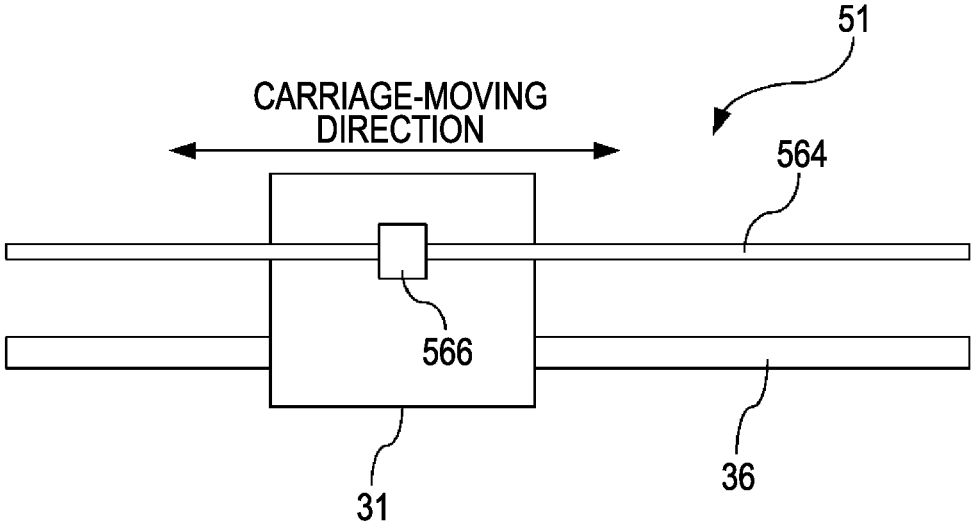
FIG. 4A briefly illustrates a configuration of a linear encoder.

FIG. 4A briefly illustrates a configuration of the linear encoder 51. The linear encoder 51 includes a linear-encoder code disc 564 and a detector 566. Referring to FIG. 3A, the linear-encoder code disc 564 is attached to a frame in the ink jet printer 1. The detector 566 is attached to the carriage 31. If the carriage 31 moves along a guide rail 36, the detector 566 moves along the linear-encoder code disc 564 relative to the linear-encoder code disc 564. Thus, the detector 566 detects a moving amount of the carriage 31.

Configuration of Detector

Figure 4B:
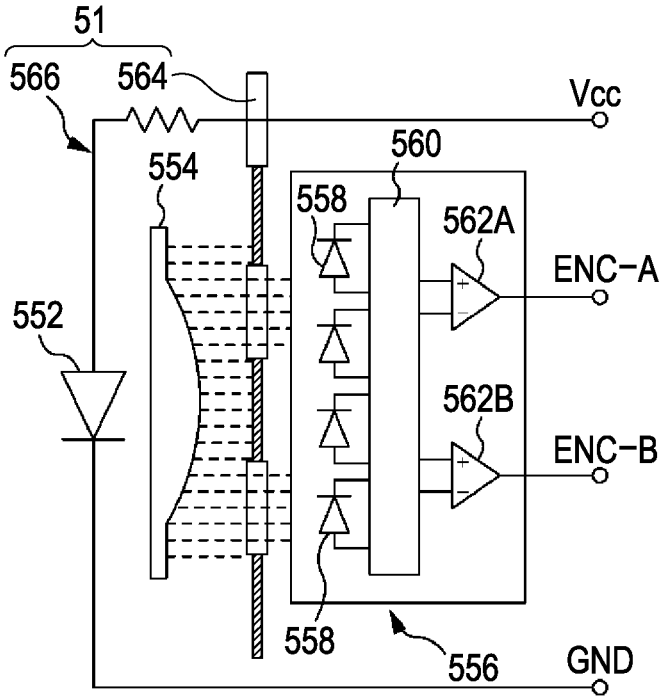
FIG. 4B schematically illustrates a configuration of a detector.

FIG. 4B schematically illustrates a configuration of the detector 566. The detector 566 includes a light-emitting diode 552, a collimator lens 554, and a detection processing unit 556. The detection processing unit 556 includes a plurality of (for example, four) photodiodes 558, a signal-processing circuit 560, and, for example, two comparators 562A and 562B.

If a voltage Vcc is applied to both ends of the light-emitting diode 552 through resistances, the light-emitting diode 552 emits light. The light is collimated by the collimator lens 554, and passes through the linear-encoder code disc 564. The linear-encoder code disc 564 has slits at a predetermined interval (for example, 1/180 inch, where 1 inch equals to 2.54 cm).

The parallel light (collimated light), which has passed through the linear-encoder code disc 564, passes through a fixed slit (not shown), enters the photodiodes 558, and is converted into an electric signal. Electric signals output from the four photodiodes 558 are processed in the signal-processing circuit 560. The signals output from the signal-processing circuit 560 are compared in the comparators 562A and 562B. The comparison results are output in the form of pulses. The comparator 562A outputs a pulse ENC-A, and the comparator 562B outputs a pulse ENC-B. The pulses ENC-A and ENC-B serve as the outputs from the linear encoder 51.

Output Signal

Figure 5A:
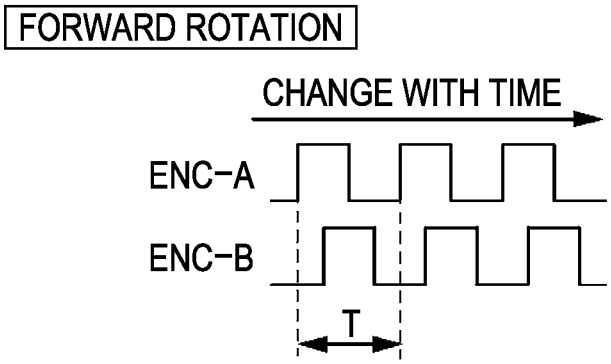
FIG. 5A is a timing chart showing waveforms of two output signals of the detector during forward rotation of a carriage motor.
Figure 5B:
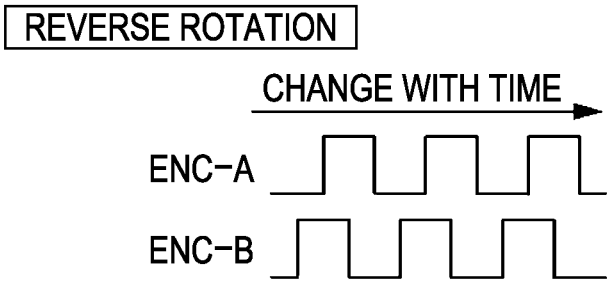
FIG. 5B is a timing chart showing waveforms of two output signals of the detector during reverse rotation of the carriage motor.

FIG. 5A is a timing chart showing waveforms of two output signals of the detector 566 during forward rotation of the carriage motor 32. FIG. 5B is a timing chart showing waveforms of two output signals of the detector 566 during reverse rotation of the carriage motor 32. Referring to 5A and 5B, the phase of the pulse ENC-A differs from the phase of the pulse ENC-B by 90 degrees during the forward rotation and the reverse rotation of the carriage motor 32. When the carriage motor 32 rotates forward, that is, when the carriage 31 moves along the guide rail 36, the phase of the pulse ENC-A is advanced by 90 degrees as compared with the phase of the pulse ENC-B as shown in FIG. 5A. When the carriage motor 32 reversely rotates, the phase of the pulse ENC-A is delayed by 90 degrees as compared with the phase of the pulse ENC-B as shown in FIG. 5B. A single period T of each of the pulse ENC-A and the pulse ENC-B is equivalent to a time in which the carriage 31 is moved by a distance corresponding to the interval of the slits of the linear-encoder code disc 564.

Rising edges of each of the output pulses ENC-A and ENC-B of the linear encoder 51 are detected, the number of the detected edges is counted, and the rotational position of the carriage motor 32 is calculated on the basis of the count value. A value "1" is added to the count value if one edge is detected while the carriage motor 32 rotates forward. A value "−1" is added to the count value if one edge is detected while the carriage motor 32 reversely rotates. The period of each of the pulses ENC-A and ENC-B is equivalent to a time from when a slit of the linear-encoder code disc 564 passes the detector 566 to when the next slit passes the detector 566. Also, the phase of the pulse ENC-A differs from the phase of the pulse ENC-B by 90 degrees. Thus, the count value "+1" corresponds to ¼ of the interval of the slits of the linear-encoder code disc 564. By multiplying the count value by ¼ of the interval of the slits, a moving amount of the carriage motor 32 from a rotational position, at which the count value is "0," can be obtained on the basis of the multiplication value. At this time, the resolution of the linear encoder 51 is ¼ of the interval of the slits of the linear-encoder code disc 564.

Figure 6A:
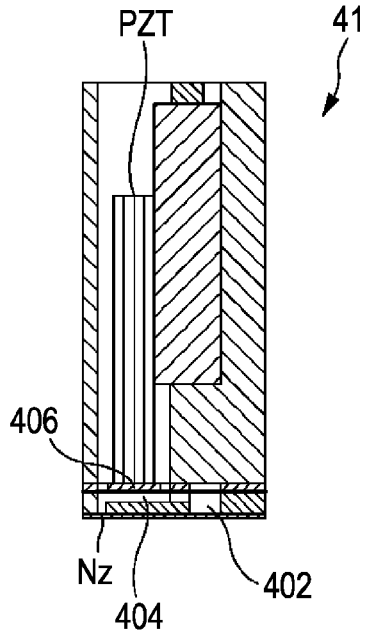
FIG. 6A is an explanatory view showing a structure of a head.

FIG. 6A is an explanatory view showing a structure of the head 41. FIG. 6A illustrates a nozzle Nz, a piezoelectric element PZT, an ink supply channel 402, a nozzle communication channel 404, and an elastic plate 406.

The ink supply channel 402 is supplied with ink from an ink tank (not shown). The ink is supplied to the nozzle communication channel 404. A pulse of a drive signal (described later) is applied to the piezoelectric element PZT. When the pulse is applied, the piezoelectric element PZT expands and contracts in accordance with the signal of the pulse, and vibrates the elastic plate 406. Accordingly, the nozzle Nz ejects ink droplets by an ink quantity corresponding to the amplitude of the pulse.

Nozzles

Figure 6B:
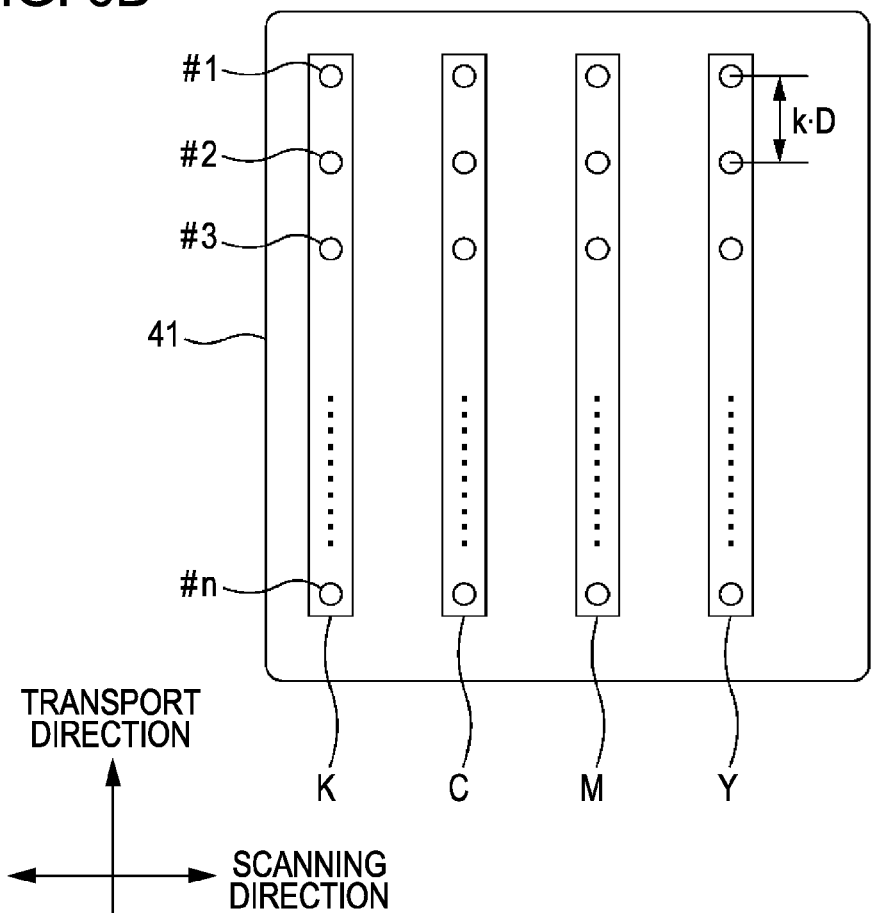
FIG. 6B is an explanatory view showing arrangement of nozzles in a lower surface of the head.

FIG. 6B is an explanatory view showing arrangement of nozzles in a lower surface of the head 41. A black-ink nozzle array K, a cyan-ink nozzle array C, a magenta-ink nozzle array M, and a yellow-ink nozzle array Y are formed in the lower surface of the head 41. Each nozzle array has a plurality of nozzles (180 nozzles in this embodiment). Each nozzle serves as an ejection port that ejects ink of each color.

The nozzles in each nozzle array are arranged in the transport direction at a regular interval (nozzle pitch of k·D). D is a minimum dot pitch in the transport direction (that is, an interval of dots formed on a sheet S with a highest resolution), and k is an integer equal to or greater than 1. For example, if the nozzle pitch is 180 dpi (1/180 inch), and the dot pitch in the transport direction is 720 dpi (1/720 inch), k=4.

Different numbers are assigned to the nozzles in each nozzle array (#1 to #180). A smaller number is assigned to a nozzle located at the downstream side. That is, the nozzle #1 is located downstream the nozzle #180 in the transport direction. Each nozzle is provided with a piezoelectric element (not shown) serving as a drive element that drives the nozzle to eject ink droplets.

Driving Head

Figure 7A:
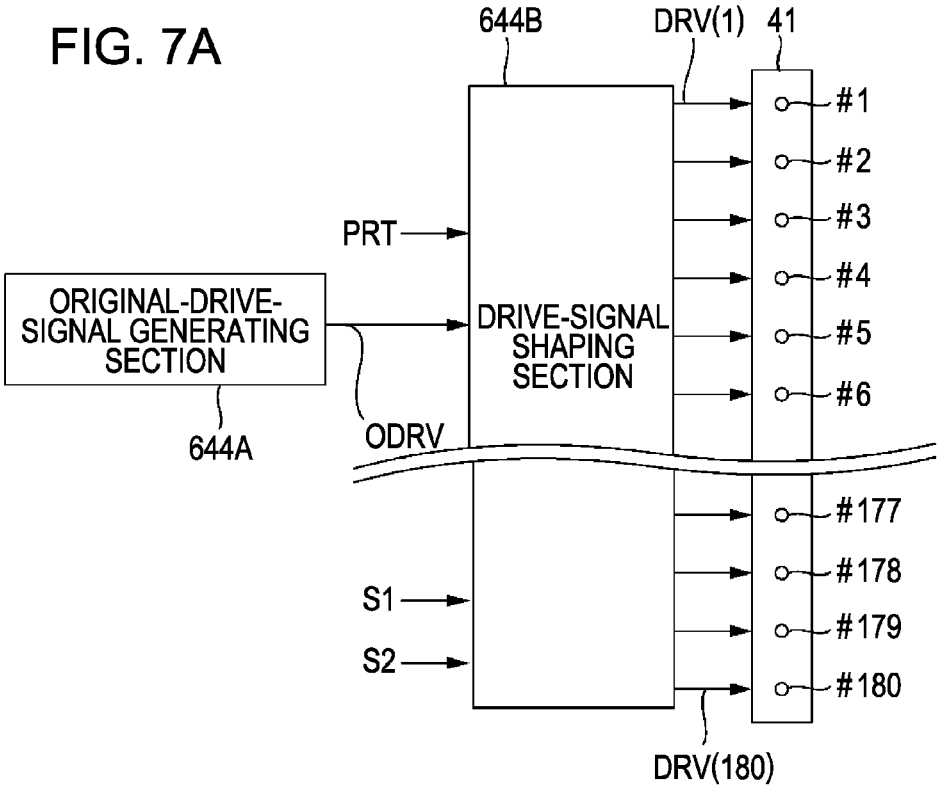
FIG. 7A is an explanatory view showing a drive circuit of a head unit.

FIG. 7A is an explanatory view showing a drive circuit of the head unit 40. The drive circuit is provided in the units-controlling circuit 64. Referring to FIG. 7A, the drive circuit includes an original-drive-signal generating section 644A and a drive-signal shaping section 644B. The drive circuit for the nozzles #1 to #180 is provided for each nozzle group, that is, for each of the nozzle arrays of black (K), cyan (C), magenta (M), and yellow (Y). In addition, each nozzle is driven by the individual piezoelectric element. Referring to FIG. 7A, a number in parentheses at the end of the name of each signal indicates the number of nozzle to which the signal is supplied.

When a voltage with a predetermined time width is applied to electrodes at both ends of the piezoelectric element, the piezoelectric element expands in accordance with the voltage-applied time, and deforms a side wall of an ink flow channel. Accordingly, the volume of the ink flow channel contracts as the piezoelectric element expands. Each of the nozzles #1 to #180 of each color ejects ink droplets by an ink quantity corresponding to the contraction volume of the ink flow channel.

The original-drive-signal generating section 644A generates an original signal ODRV that is commonly used for the nozzles #1 to #180. The original signal ODRV includes a plurality of pulses within a main-scanning period for a single pixel (i.e., within a time in which the carriage 31 moves across a distance of a single pixel).

The drive-signal shaping section 644B receives the original signal ODRV from the original-drive-signal generating section 644A, and a print signal PRT as serial data.

Figure 7B:
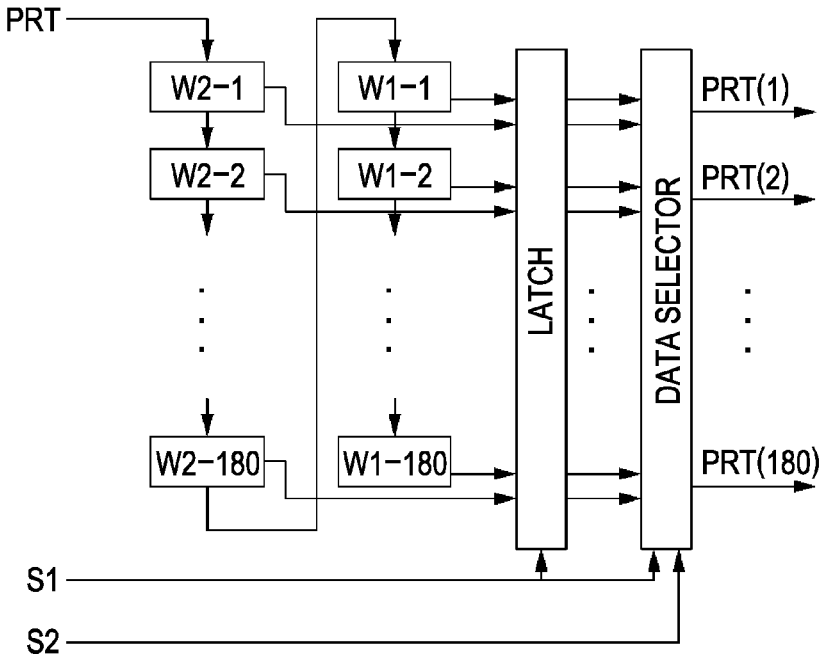
FIG. 7B is an explanatory view showing the drive circuit.

FIG. 7B is an explanatory view showing the drive circuit. The circuit shown in FIG. 7B performs serial/parallel conversion for the print signal PRT by using 360 shift resistors, so that the print signal PRT is converted into PRT(i) that indicates ON/OFF of each nozzle. The drive-signal shaping section 644B shapes the original signal ODRV in accordance with the level of the print signal PRT(i), and outputs the signal as a drive signal DRV(i) to the piezoelectric element of each of the nozzles #1 to #180. The piezoelectric element of each of the nozzles #1 to #180 is driven in accordance with the drive signal DRV from the drive-signal shaping section 644B.

Drive Signal of Head

Figure 8:
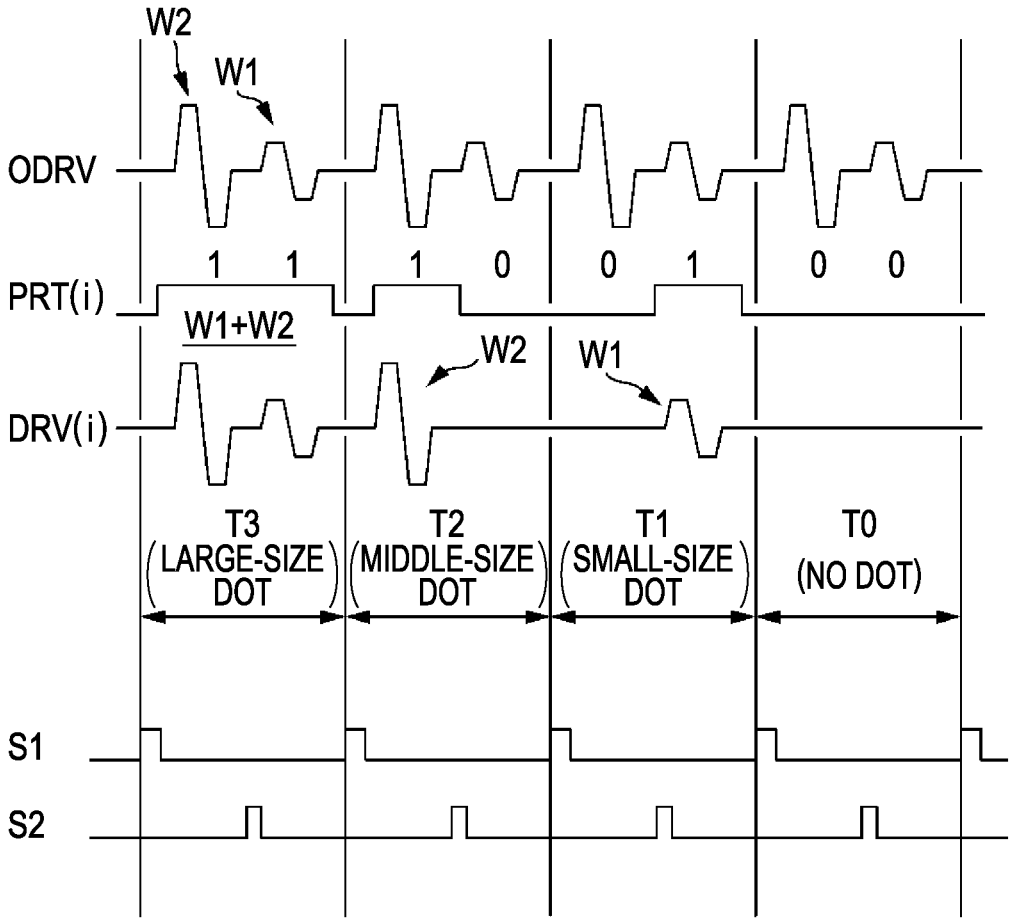
FIG. 8 is a timing chart for explaining respective signals.

FIG. 8 is a timing chart for explaining respective signals. In particular, FIG. 8 is a timing chart for the respective signals including the original signal ODRV, the print signal PRT(i), and the drive signal DRV(i). The print signal PRT(i) is generated from the print signal PRT.

The original signal ODRV is commonly supplied to the nozzles #1 to #180 from the original-drive-signal generating section 644A. In this embodiment, the original signal ODRV includes two pulses of a first pulse W1 and a second pulse W2 within a main-scanning period for a single pixel (i.e., within a time in which the carriage 31 moves across a distance of a single pixel). The original signal ODRV is output from the original-drive-signal generating section 644A to the drive-signal shaping section 644B.

The print signal PRT(i) corresponds to pixel data that is allocated to a single pixel. That is, the print signal PRT(i) corresponds to pixel data contained in print data. In this embodiment, the print signal PRT(i) includes two-bit information per pixel, for a nozzle #1. The drive-signal shaping section 644B shapes the original signal ODRV in accordance with the level of the print signal PRT(i), and outputs the drive signal DRV.

The drive signal DRV is obtained when the original signal ODRV is blocked in accordance with the level of the print signal PRT(i). In particular, when the print signal PRT(i) is at a level 1, the drive-signal shaping section 644B allows the pulse corresponding to the original signal ODRV to pass, so that the pulse directly becomes the drive signal DRV. In contrast, when the print signal PRT(i) is at a level 0, the drive-signal shaping section 644B blocks the pulse of the original signal ODRV. The drive-signal shaping section 644B outputs the drive signal DRV to the piezoelectric element provided for each nozzle. Then, the piezoelectric element is driven in accordance with the drive signal DRV.

Referring to FIG. 7B, the control signal S1 is input to a latch circuit and a data selector. The control signal S2 is input to the data selector. Referring to FIG. 8, the control signals S1 and S2 indicate timings at which the print signal PRT(i) is changed. The control signals S1 and S2 are generated on the basis of pulse timing signals (PTS signals). The PTS signals regulate timings at which pulses are generated for the control signals S1 and S2. Pulses of the PTS signals are generated on the basis of the output pulses ENC-A and ENC-B from the linear encoder 51 (the detector 566). That is, a pulse of a PTS signal is generated in accordance with a moving amount of the carriage 31.

The serially transmitted print signal PRT is converted into 180 pieces of two-bit data (parallel data) as follows. First, the print signal PRT is input into 360 shift resistors. When the pulse of the control signal S1 is input to the latch circuit, the 360 pieces of data in the respective shift resistors are latched. The data selector selects the data latched in the latch circuit and outputs the selected data. When the pulse of the control signal S1 is input to the latch circuit, the pulse of the control signal S1 is also input to the data selector. When the pulse of the control signal S1 is input to the data selector, the data selector is brought into an initial state. The data selector in the initial state selects the data, which has been stored in a shift resistor W2-*i* before the data is latched, and the data selector outputs the data as PRT(i). The data selector in the initial state selects the data, which has been stored in a shift resistor W1-*i* before the data is latched, and the data selector outputs the data as PRT(i). In this way, the serially transmitted print signal PRT is converted into the 180 pieces of two-bit data. The control signal S1 determines ejection or non-election in association with the second pulse W2. The second signal S2 determines ejection or non-ejection in association with the first pulse W1.

When the print signal PRT(i) corresponds to two-bit data "01," only the first pulse W1 is output in the latter half of a single pixel period. Accordingly, the nozzle ejects a small-size ink droplet, and hence a small-size dot is formed on a sheet. When the print signal PRT(i) corresponds to two-bit data "10," only the second pulse W2 is output in the former half of a single pixel period. Accordingly, the nozzle ejects a middle-size ink droplet, and hence a middle-size dot is formed on the sheet. When the print signal PRT(i) corresponds to two-bit data "11," the first pulse W1 and the second pulse W2 are output in a single pixel period. Accordingly, the nozzle ejects a large-size ink droplet, and hence a large-size dot is formed on the sheet. When the print signal PRT(i) corresponds to two-bit data "00," the first pulse W1 or the second pulse W2 is not output. Accordingly, the ink is not ejected in a single pixel period, and hence, no dot is formed.

As described above, the drive signal DRV(i) in the single pixel period is formed so as to have four different waveforms in accordance with the four different values of the print signal PRT(i).

Figure 9:
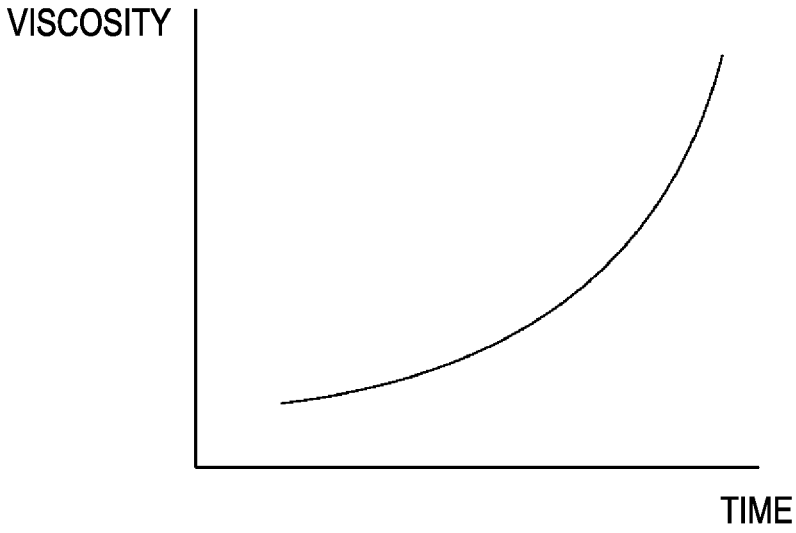
FIG. 9 illustrates viscosity of ink with respect to time lapse.

FIG. 9 illustrates viscosity of ink with respect to time lapse. In FIG. 9, the horizontal axis plots time lapse, and the vertical axis plots viscosity of ink. The viscosity of the ink may increase in an area near the nozzles of the head 41 because of evaporation. If the viscosity increases, the ink is not smoothly ejected from the nozzle.

To prevent the non-smooth ejection of the ink from the nozzle, a "flushing operation" may be performed. The flushing operation is an operation that moves the head 41 to a predetermined position, at which the ink does not adhere to a medium, and ejects the thickening ink.

Referring back to FIG. 3A, the head cap 80 is provided. When the flushing operation is performed, the head 41 is moved to the position of the head cap 80, and the head 41 is fitted to the head cap 80. While the head 41 is fitted to the head cap 80, the nozzle ejects the ink, so as to eject the thickening ink. Accordingly, ink that is not thickening is supplied to an area around the nozzle.

If the flushing operation is performed, the ink, which should be used for forming an image, is consumed for the purpose other than printing. However, if the thickening ink is used, the ejection speed of the ink may decrease. This may adversely affect image formation.

Figure 10:
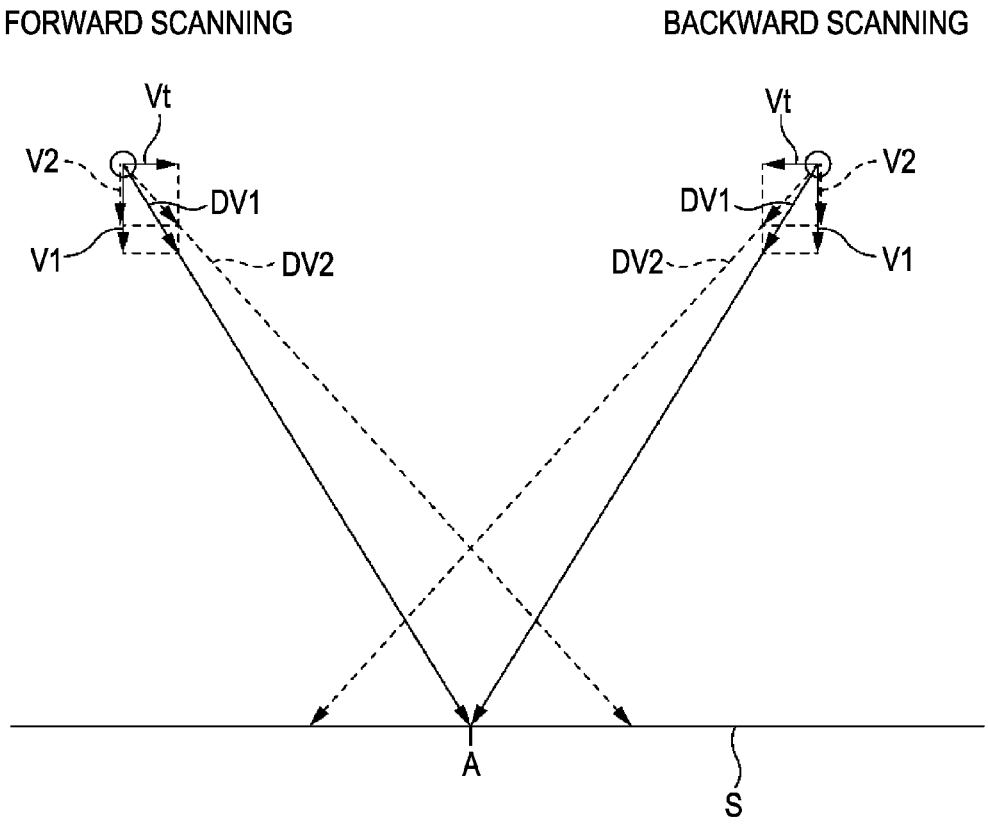
FIG. 10 is an explanatory view showing landing positions of ink during bidirectional printing.

FIG. 10 is an explanatory view showing landing positions of ink during bidirectional printing. FIG. 10 illustrates speeds, at which ink is ejected during the forward scanning and the backward scanning, in the form of vectors. Herein, the head 41 moves at a moving speed Vt during the forward scanning and the backward scanning. A position A in FIG. 10 is a target landing position of the ink during the forward scanning and a target landing position of the ink during the backward scanning. It is desirable to eject the ink onto the sheet S at an ejection speed V1 with the vector of DV1 directed toward the landing position A, so that the ink is ejected onto the landing position A during both the forward scanning and the backward scanning.

However, the ejection speed of the ink may be lower than V1. FIG. 10 illustrates an ejection speed V2 of the ink when the ink ejection speed is low. When the ejection speed is decreased, although the ink is ejected at the same timing as the former case, the vector of DV2 is not directed to the position A, resulting in that the ink is landed at a position exceeding the target landing position A. Then, a landing position of the ink during the forward scanning may be shifted from a landing position of the ink during the backward scanning in the moving direction of the head 41.

Thus, the flushing operation that consumes the ink for the purpose other than printing should not be performed, so that the thickening ink is ejected and printing in a good condition is performed at a speed as high as possible. In a printing process according to this embodiment, the process attains the above request by selecting a printing method depending on a hold period of the head 41 (the degree of viscosity of the ink).

Figure 11:
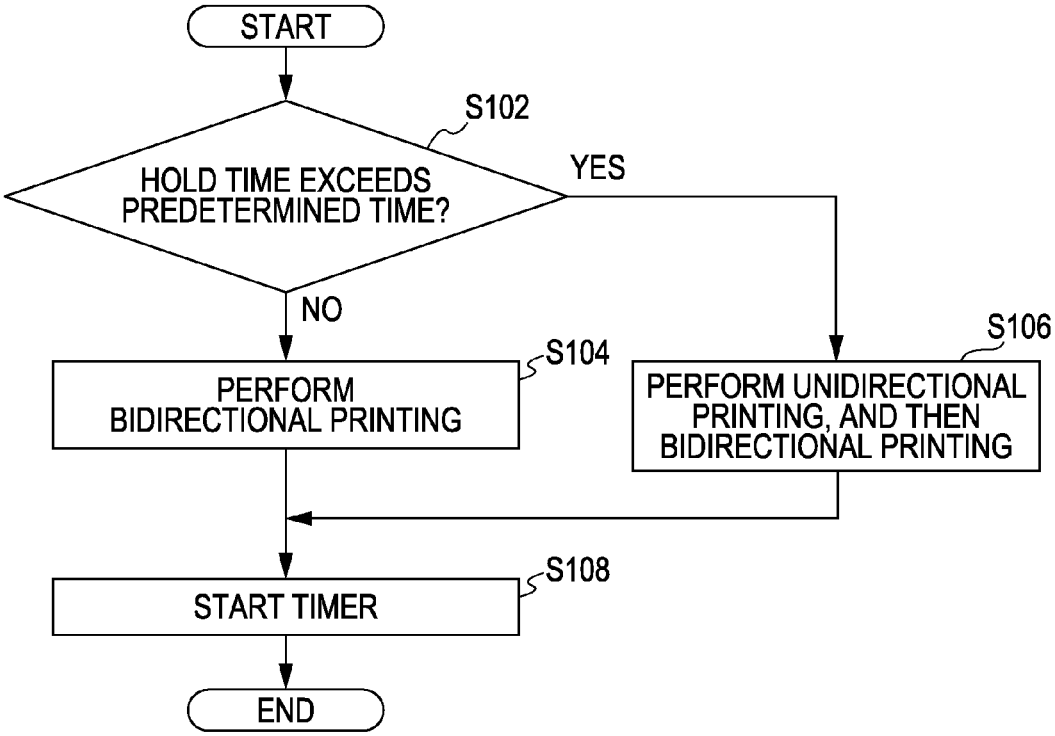
FIG. 11 is a flowchart showing a printing process according to the embodiment.

FIG. 11 is a flowchart showing a printing process according to the embodiment.

When printing is started, it is determined whether a hold time (hold period) exceeds a predetermined time (S102). The hold time is a time which elapses since the ink has been ejected last from the head 41. The time at which the ink has been ejected last from the head 41 is counted by a timer in step S108 (described later). In other words, the hold time used for the comparison is a time since a last printing process has been completed.

In step S102, if the hold time does not exceed the predetermined time, the ink is ejected during both the forward scanning and the backward scanning of the head 41, and bidirectional printing is performed (S104). As described above, if the hold time does not exceed the predetermined time, the ink is not so thickening, and the viscosity of the ink does not affect print quality. Hence, the bidirectional printing is performed to complete printing at a high speed.

In contrast, in step S102, if the hold time exceeds the predetermined time, the ink is ejected during one of the forward scanning and the backward scanning of the head 41, and unidirectional printing is performed. The unidirectional printing is performed on a certain number of sheets (for example, only a first page). Then, the ink is ejected during both the forward scanning and the backward scanning of the head 41 to perform the bidirectional printing (S106).

If the hold time exceeds the predetermined time, and the viscosity of the ink is high, the ejection speed of the ink may be low. As described above, if the ejection speed of the ink is low, although the target landing position during the forward scanning is aligned with the target landing position during the backward scanning, the actual landing positions may be shifted from one another, resulting in that the image quality being degraded. In contrast, with this embodiment, the unidirectional printing is performed on the predetermined number of sheets. Thus, the problem, in which the landing positions of the ink are shifted from one another between the forward scanning and the backward scanning, does not occur.

Also, since the thickening ink is used during the unidirectional printing, the flushing operation does not have to be performed. The consumption of the ink can be decreased. In addition, after the unidirectional printing for the predetermined number of sheets is completed, the printing is changed to the bidirectional printing. Thus, the consumption of the ink can be decreased without the printing speed being sacrificed.

When the printing is completed in step S104 or S106, the controller 60 starts the operation of the timer. The timer measures the hold time in which the head 41 does not eject the ink (S108). Hence, it can be determined whether the hold time exceeds the predetermined time when next printing is performed. The printing process is completed. However, the measurement for the hold time is continuously performed.

In this embodiment, the timing at which the unidirectional printing is changed to the bidirectional printing in step S106 is based on the number of printed sheets. Alternatively, the unidirectional printing may be changed to the bidirectional printing depending on a timing at which the ejection of the ink by a predetermined ink quantity is completed. Still alternatively, the unidirectional printing may be changed to the bidirectional printing at a timing at which a predetermined time elapses since a printing start time.

Also, since the ejection speed of the ink is decreased because of the thickening ink, the moving speed of the head 41 may be decreased accordingly. In this case, the moving speed during the unidirectional printing is desirably lower than the moving speed during the bidirectional printing.

Modifications

In the above-described embodiments, the printer 1 has been described as the liquid ejecting apparatus, however, it is not limited thereto. The apparatus may be implemented by a liquid ejecting apparatus that ejects liquid other than ink (liquid, a liquid-like object in which particles of a functional material are dispersed, or a fluid-like object such as gel). For example, a technique similar to that according to the embodiment may be applied to various apparatuses, such as a color-filter manufacturing apparatus, a dyeing apparatus, a micro-processing apparatus, a semiconductor fabricating apparatus, a surface processing apparatus, a three-dimensional molding apparatus, a liquid vaporizing apparatus, an organic electroluminescence (EL) manufacturing apparatus (in particular, a polymer EL manufacturing apparatus), a display manufacturing apparatus, a film forming apparatus, and a DNA-chip manufacturing apparatus, which use the ink jet technique. Also, a method derived from such an apparatus and a manufacturing method of such an apparatus may be included in the range of application.

The embodiments are provided for easy understanding of the invention, but not for interpretation of the invention in a limited way. The invention may be modified and improved within the scope of the invention, and may include equivalents thereof.

Head

In any of the above-described embodiments, the ink has been ejected by using the piezoelectric element. However, the method of ejecting liquid is not limited thereto, and other methods may be used. For example, a method of generating bubbles in a nozzle using heat may be applied.

The entire disclosure of Japanese Patent Application No. 2009-244171, filed Oct. 23, 2009 is expressly incorporated by reference herein.

What is claimed is:

1. A liquid ejecting apparatus comprising:

a head that ejects liquid on a medium;

a head-moving unit that moves the head in a moving direction;

a timer that measures a hold period in which the head does not eject the liquid; and a controller that controls ejection of the liquid from the head in accordance with the hold period, the controller selects one of modes in accordance with the measured hold period to eject the liquid, the modes including one of:

a first mode in which the head ejects the liquid during only one of forward scanning and backward scanning in the moving direction for a plurality of scans, and then ejects the liquid during the forward scanning and the backward scanning in the moving direction, and a second mode in which the head ejects the liquid during the forward scanning and the backward scanning in the moving direction.

2. The liquid ejecting apparatus according to claim 1, wherein the controller controls the head to eject the liquid in the first mode if the hold period is longer than a predetermined period.

3. The liquid ejecting apparatus according to claim 1, wherein the controller controls the head to eject the liquid in the second mode if the hold period is a predetermined period or shorter.

4. The liquid ejecting apparatus according to claim 1, wherein the head ejects the liquid during only one of the forward scanning and the backward scanning in the moving direction in the first mode until the ejection of the liquid on a predetermined number of media is completed.

5. The liquid ejecting apparatus according to claim 1, wherein the head ejects the liquid during only one of the forward scanning and the backward scanning in the moving direction in the first mode until the ejection of the liquid by a predetermined liquid quantity is completed.

6. The liquid ejecting apparatus according to claim 1, wherein the head ejects the liquid during only one of the forward scanning and the backward scanning in the moving direction in the first mode until a predetermined time elapses.

7. The liquid ejecting apparatus according to claim 1, wherein a moving speed of the head when the head ejects the liquid during only one of the forward scanning and the backward scanning in the moving direction in the first mode is lower than a moving speed of the head when the head ejects the liquid during the forward scanning and the backward scanning in the moving direction.

8. A liquid ejecting method comprising:

measuring a hold period of a head that ejects a liquid on a medium, the hold period being a period in which the head does not eject the liquid; and ejecting the liquid by selecting one of processes in accordance with the hold period, the processes including ejecting the liquid from the head during only one of forward scanning and backward scanning in the moving direction of the head for a plurality of scans, and then ejecting the liquid during the forward scanning and the backward scanning in the moving direction, and ejecting the liquid from the head during the forward scanning and the backward scanning in the moving direction.

* * * * *